US006687915B2

(12) United States Patent
Kear

(10) Patent No.: US 6,687,915 B2
(45) Date of Patent: Feb. 10, 2004

(54) ZIPPERED NECKTIE, AND NECKTIE KNOT SUPPORT

(75) Inventor: Hom Kear, Ashburn, VA (US)

(73) Assignee: Hamilton Ties, Inc., Chantilly, VA (US)

( * ) Notice: Subject to any disclaimer, the term of this patent is extended or adjusted under 35 U.S.C. 154(b) by 37 days.

(21) Appl. No.: 10/101,397

(22) Filed: Mar. 20, 2002

(65) Prior Publication Data

US 2003/0177564 A1 Sep. 25, 2003

(51) Int. Cl.[7] ..... A41D 25/02
(52) U.S. Cl. ..... 2/148; 2/149; 2/152.1
(58) Field of Search ..... 2/144–151, 152.1, 2/153–157; 24/49.1, 50, 56–58

(56) References Cited

U.S. PATENT DOCUMENTS

| | | | | |
|---|---|---|---|---|
| 3,898,698 A | | 8/1975 | Byrd et al. | |
| 4,337,539 A | * | 7/1982 | Najarian | 2/153 |
| 4,513,453 A | | 4/1985 | Chen et al. | |
| 4,615,048 A | | 10/1986 | Gasser | |
| 4,656,672 A | | 4/1987 | Lande | |
| 4,710,982 A | | 12/1987 | Lande | |
| 4,771,481 A | | 9/1988 | Gasser | |
| 4,835,794 A | | 6/1989 | Chen et al. | |
| 4,856,114 A | | 8/1989 | Chen et al. | |
| 4,897,887 A | | 2/1990 | Chen et al. | |
| 5,048,127 A | | 9/1991 | Yang | |
| 5,113,531 A | | 5/1992 | Castro | |
| 5,170,507 A | | 12/1992 | Langford et al. | |
| 5,390,370 A | | 2/1995 | Koy | |
| 5,416,926 A | | 5/1995 | Koy | |
| 5,555,563 A | | 9/1996 | Ear | |

FOREIGN PATENT DOCUMENTS

| | | |
|---|---|---|
| FR | 1 178 162 | 5/1959 |
| WO | WO 94/01009 | 1/1994 |

* cited by examiner

*Primary Examiner*—Tejash Patel
(74) *Attorney, Agent, or Firm*—Oliff & Berridge, PLC

(57) ABSTRACT

A knot support for a necktie, includes a wedge shaped front having a wide upper portion and a narrow lower portion. A top edge of the wedge shaped front forms a V-shape and each side of the V-shape defines a substantially continuous curve as seen in frontal view. A necktie, such as a zippered necktie, is attached to the knot support. The necktie may be attached to a wearer's neck by a loop portion that forms a loop and has ends engageable by the knot support. The knot support is slidable relative to the loop portion to adjust a size of the loop.

37 Claims, 4 Drawing Sheets

ZIPPERED NECKTIE, AND NECKTIE KNOT SUPPORT

BACKGROUND OF THE INVENTION

1. Field of Invention

This invention relates to neckties, and to knot supports for neckties.

2. Description of Related Art

Various types of neckties are known. A zipper necktie is a type of pre-tied necktie, in which a front fabric portion of the tie is permanently or semi-permanently attached to a knot support with a generally wedge shaped front profile. A loop portion of the zipper necktie has ends engaged by the knot support, and the knot support is slidable relative to the loop portion to adjust a size of the loop around a wearer's neck.

U.S. Pat. Nos. 5,555,563 and 5,048,127 disclose examples of such neckties, in which the generally wedge shaped knot support has a flat top edge, i.e., an edge contained in a single plane.

U.S. Pat. No. 5,416,926 discloses a zipper necktie with a knot support that has a V-shaped top edge, as seen in frontal view. The knot support also has upstanding side walls standing perpendicular to the planar front of the knot support and extending along the entire length of the side edges of the knot support. The upstanding walls are provided to shape the knot of the necktie and to provide a braking action so that the tie will not slip when the loop is opened and closed.

SUMMARY OF THE INVENTION

However, various disadvantages exist in the prior art. For example, when upstanding side walls are provided on the knot support, as in the above-mentioned U.S. Pat. No. 5,416,926, the knot support tends to wear out and/or wrinkle the fabric of the tie. Furthermore, when the knot support has a flat top edge, as in the above-mentioned U.S. Pat. Nos. 5,555,563 and 5,048,127, the resulting tie knot has a slightly unnatural appearance.

The present invention address these and other problems, and provides various other advantages, by providing a knot support for a necktie. The knot support includes a wedge shaped front having a wide upper portion and a narrow lower portion. The top edge of the wedge shaped front forms a V-shape having two sides, each of which, in embodiments, defines a substantially continuous curve as seen in frontal view.

In embodiments, outside edges of a lower portion of the wedge shaped front are substantially free of any rearwardly extending wall.

The knot support preferably further includes a pair of prongs extending toward each other from opposite sides of an upper portion of the wedge shaped front. In embodiments, each prong is bent toward the wedge shaped front such that an imaginary line drawn as an extension of the prong intersects the wedge shaped front at a point of intersection such that, as seen in top view, a ratio of (1) a maximum interior width between the prongs to (2) a distance between the points of intersection is greater than or equal to 1.5:1.

Preferably, as seen in rear view, a top edge of each prong is positioned below the opt edge of the wedge shaped front. Furthermore, preferably, outside upper corners of the wedge shaped front are rounded as seen in frontal view.

These and other objects, advantages and salient features of the invention are described in or apparent from the following detailed description of exemplary embodiments.

BRIEF DESCRIPTION OF THE DRAWINGS

Exemplary embodiments of the invention will be described with reference to the following drawings, wherein like numerals represent like parts, and wherein.

DETAILED DESCRIPTION OF PREFERRED EMBODIMENTS

Figure 1:
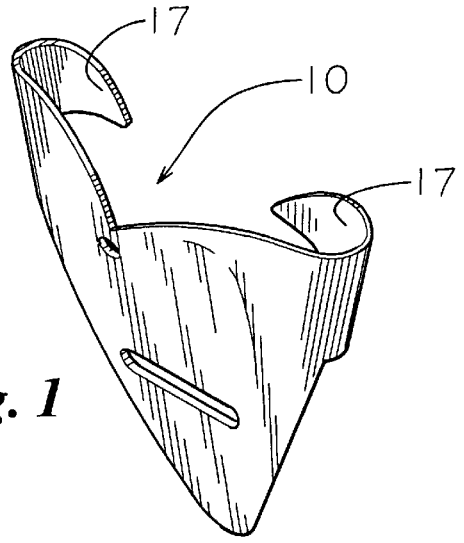
FIG. 1 is an oblique view of a first exemplary knot support according to the invention.

FIG. 1 is an oblique view of a first exemplary knot support 10 according to the invention. As shown in the frontal view of FIG. 2, the knot support 10 includes an upper portion 12 and a lower portion 14. The knot support 10 may be constructed from metal, but is preferably of a polymeric material such as polyolefins or polystyrenes, or copolymers thereof, acrylonitrile/butadiene/styrene copolymers, polyacrylates, polymethacrylates, phenolics or the like. Polymeric material is typically preferable from the standpoint of ease of manufacturing and cost, and also because it does not rust when washed along with a necktie.

Figure 2:
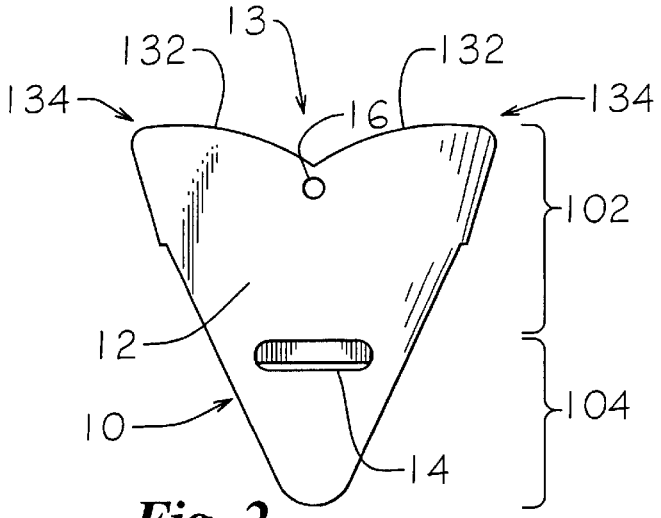
FIG. 2 is a frontal view of the knot support of FIG. 1.

As shown in FIG. 2, the knot support 10 has a wide upper portion 102 and a narrower lower portion 104. The knot support 10 has a generally wedge shaped front 12 with a V-shaped top edge 13. The generally wedge shaped front is preferably generally triangular, as opposed to generally T-shaped as in some conventional knot supports, because the generally triangular shape is more effective at reducing twisting of the knot support 10 relative to the tie fabric during sliding of the tie knot to tighten or loosen the necktie.

Each side 132 of the V-shaped top edge 13 defines, in this embodiment, a continuous curve. The outside upper corners 134 of the wedge shaped front 12 are preferably rounded. When the knot support 10 is assembled in a necktie, as described in detail below, the continuous curve of the sides 132 of the top edge and the rounded corners both contribute to a necktie knot with a better appearance than with conventional knot supports, for the following reasons.

First, the V-shape of the top edge 13 provides a space in which the underlying layers of the tie fabric can nest, thereby being better covered by the overlying layers of the tie fabric. Second, the rounded outside upper corners 134 of the knot support 10 reduce the effect of the underlying layers of the tie fabric extruding noticeably at the upper corners of the tie knot.

The V-shape of the top edge 13 provides other advantages as well. For example, the tie fabric is more easily retained in place on the knot support 10 due to the V-shape, and does not tend to slide from side to side. Additionally, the V-shape allows the knot support 10 to fit more comfortably around the wearer's Adam's apple.

The continuous curve of the sides 132 of the top edge 13 is advantageous because it allows the V-shape to have a slightly sharper point than with a straight-sided V-shape, and because it allows a smooth, continuous transition between the V-shape and the upper corners 134.

It should be appreciated that, while the best effect is achieved by having both the V-shape and the rounded upper corners, some effect may be achieved by having only the rounded upper corners or only the V-shape. Furthermore, while the best effect is achieved by having a V-shape with continuously curved sides, some effect may be achieved by a V-shape with straight sides.

A hole 16 is provided near the top center of the knot support 10, to facilitate attachment of the knot support 10 to the tie fabric as described in more detail below. A slot 14 may also be provided as shown in FIG. 2. The slot 14 serves no particular purpose in the final appearance of the tie, but may be useful in molding the horizontal loop 15, discussed in detail below.

Figure 3:
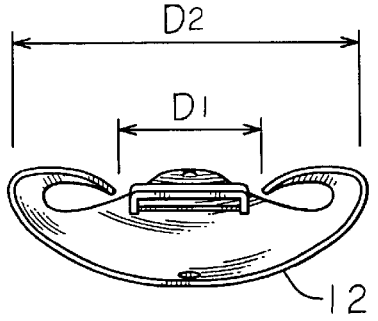
FIG. 3 is a top view of the knot support of FIG. 1.

The front 12 of the knot support 10 is preferably convex, as shown in the top view of FIG. 3. The convex shape contributes to the overall appearance of the tie knot, and also helps the knot support 10 to fit more comfortably around the wearer's Adam's apple.

Prongs 17 extend rearwardly from opposite sides of the upper portion of the knot support 10 and towards each other, such that each prong 17 is spaced from the wedge shaped front 12. The prongs 17 are spaced from each other at a spacing $D_1$. The maximum interior width $D_2$ between the prongs 17 is preferably such that the ratio of $D_2$ to $D_1$ is less than or equal to 2:1, for the following reason. If the spacing $D_1$ is too great relative to the width $D_2$, the tie fabric engaged by the prongs 17, as described below, can too easily slip out between the prongs 17. However, it should be appreciated that if the prongs 17 are too long, they can rest against the wearer's Adam's apple and become uncomfortable.

As shown in the rear view of the knot support in FIG. 4, top edges 172 of the prongs are preferably positioned below the top edge 130 of the wedge shaped front 12. This feature helps reduce the effect of the underlying layers of the tie fabric extruding noticeably at the upper corners of the tie knot.

Figure 4:
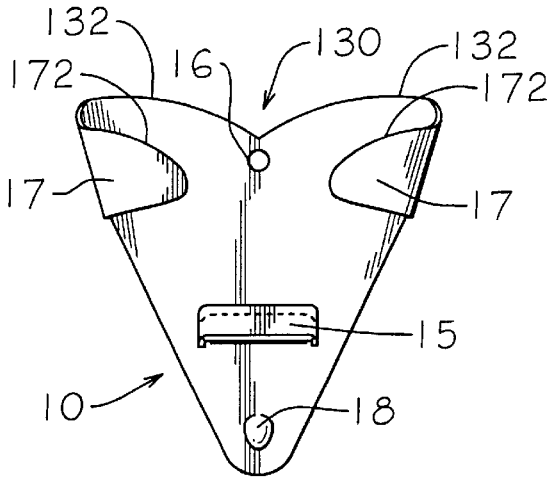
FIG. 4 is a rear view of the knot support of FIG. 1.

As shown in FIG. 4 and in the side view of FIG. 5, a horizontal loop 15 and a boss 18 extend rearwardly from the knot support 10 to accommodate the camming element of a zipper or the like, as described in detail below. The loop 15 is directly opposite the slot 14, described above. During molding of the knot support 10, a mold element (not shown) for forming the inside surface, i.e., the forward-facing surface, of the loop 15 may be positioned appropriately during molding, and then withdrawn through the slot 14 after the molding process is completed.

Figure 5:
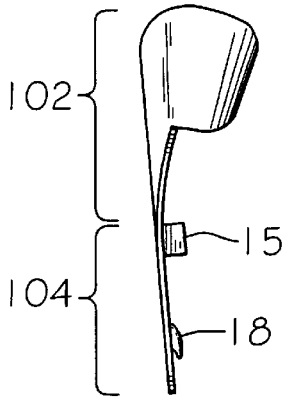
FIG. 5 is a side view of the knot support of FIG. 1.

As shown in FIGS. 4 and 5, outside edges of the lower portion 104 of the knot support 10 are substantially free of any rearwardly extending wall. This provides the following advantages. First, the tie fabric does not wear out as quickly as when rearwardly extending walls are present, as in some conventional knot supports. Second, the tie fabric does not wrinkle as easily as when rearwardly extending walls are present.

Figure 6:
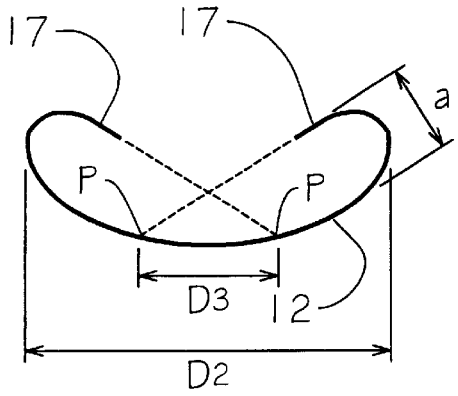
FIG. 6 is a top view outline of the top edge of the knot support of FIG. 1.

FIG. 6 is a top view outline of the top edge of the knot support 10. Each prong 17 is preferably bent toward the wedge shaped front 12 such that an imaginary line 170 drawn as an extension of the prong 17 intersects the wedge shaped front 12 at a point of intersection P such that a ratio of the maximum interior width $D_2$ between the prongs 17 to a distance $D_3$ between the points of intersection is greater than or equal to 1.5:1.

Figure 7:
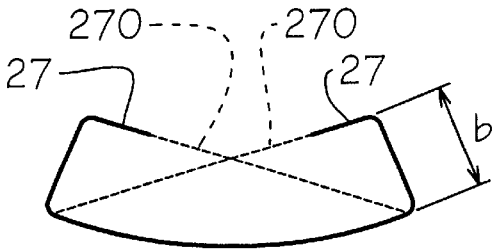
Fig. 7 (Prior Art)
FIG. 7 is a top view outline of the top edge of a first conventional knot support.

In contrast, FIG. 7 shows a proportionally accurate top view outline of the top edge of an actual knot support manufactured under the above-mentioned U.S. Pat. No. 5,555,563. It can be seen that in this case, imaginary lines 270 drawn as extensions of prongs 27 intersect the front of the knot support at points of intersection such that the distance between the points of intersection is about equal to the maximum interior width between the prongs 27, or in other words, such that the above-mentioned ratio is significantly less than 1.5:1, e.g., the ratio is about 1:1.

Figure 8:
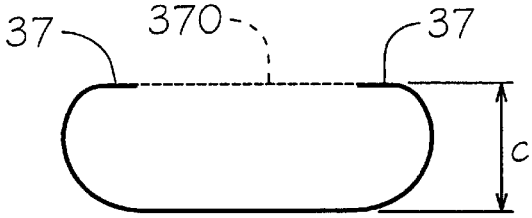
Fig. 8 (Prior Art)
FIG. 8 is a top view outline of the top edge of a second conventional knot support.

Similarly, FIG. 8 shows a proportionally accurate top view outline of the top edge of an actual knot support manufactured under the above-mentioned U.S. Pat. No. 5,048,127. It can be seen that in this case, imaginary lines 370 drawn as extensions of prongs 37 do not even intersect the front of the knot support.

A knot support of the configuration shown in FIG. 6 has an advantage over knot supports of the configurations shown in FIGS. 7 and 8. Specifically, with the configuration shown in FIG. 6, the tie fabric, e.g., the tie fabric of joining ends of a loop portion of the necktie, does not slip out of the knot support as easily as in the configurations shown in FIGS. 7 and 8.

In the actual knot support manufactured under the above-mentioned U.S. Pat. No. 5,555,563, shown in FIG. 7, the width b of the knot support is about 7 mm. In the actual knot support manufactured under the above-mentioned U.S. Pat. No. 5,048,127, shown in FIG. 8, the width c of the knot support is about 9 mm. However, in the present invention, shown in FIG. 6, the width a of the knot support 10 is preferably about 8 mm. For many tie fabrics, especially silk, a width of about 8 mm allows the tie knot to move smoothly and easily with respect to the knot support 10.

Figure 9:
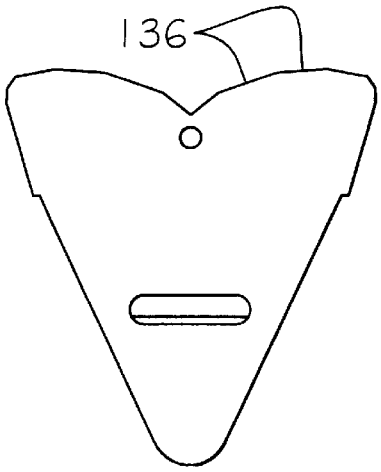
FIG. 9 is a frontal view of a second exemplary knot support according to the invention.
Figure 10:
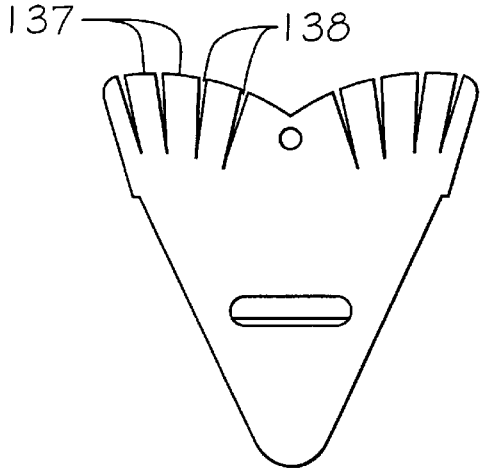
FIG. 10 is a frontal view of a third exemplary knot support according to the invention.

As shown in FIG. 2 and as discussed above, each side 132 of the V-shaped top edge 13 preferably defines a substantially continuous curve, as seen in frontal view. In FIG. 2, each side 132 of the V-shape defines the substantially continuous curve by the side itself being formed in a substantially continuous curve. However, the substantially continuous curves may alternatively be defined by sides that are not themselves continuously curved. For example, as shown in FIG. 9, the sides of the V-shape may be shaped as a plurality of linear segments 136 arranged end-to-end along a continuously curved path. As another example, as shown in FIG. 10, the sides of the V-shape may include a plurality of linear or curved segments 137, arranged along a continuously curved path but having notches 138 formed therebetween. Thus, it can be appreciated that various configurations of the sides 132 of the V-shape may define a substantially continuous curve.

Figure 11:
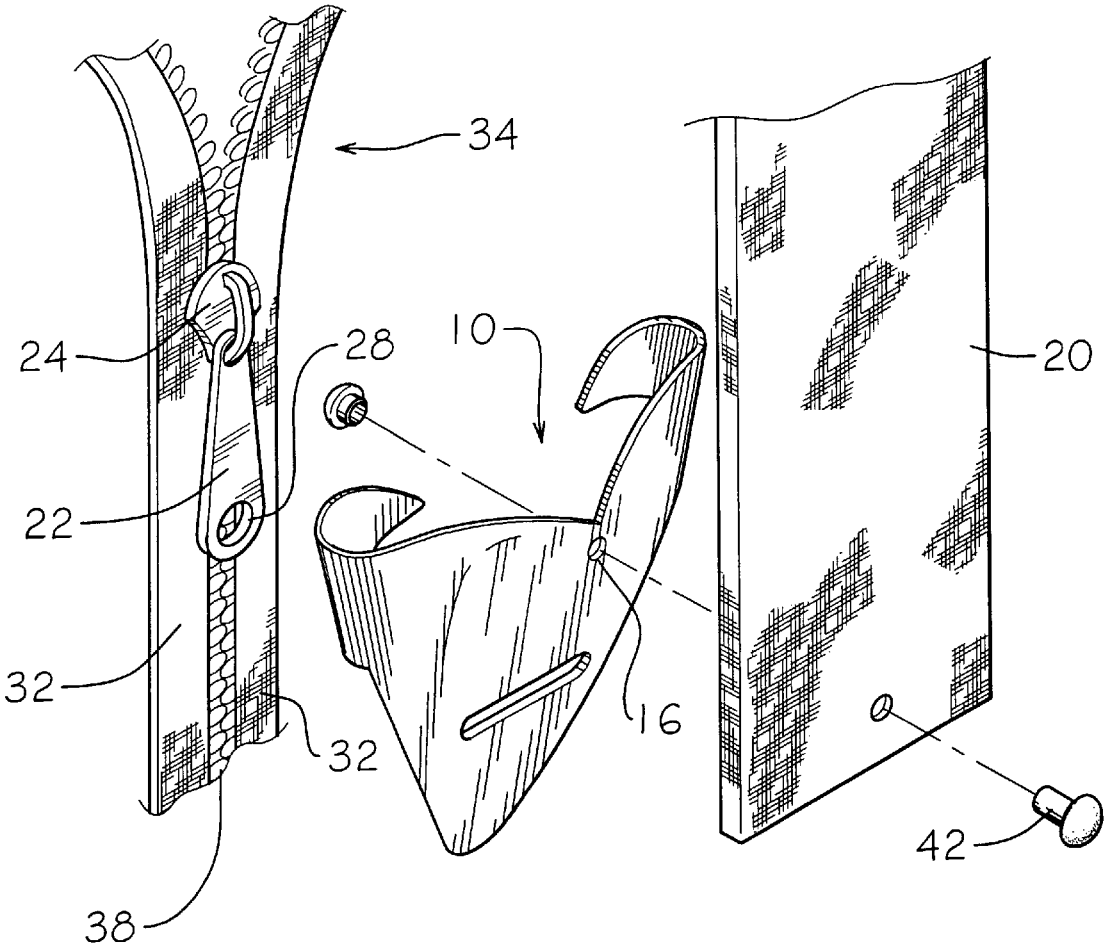
FIG. 11 is an exploded view of a necktie according to the invention.

FIG. 11 is an exploded view of a necktie according to the invention. A camming element 24 includes an operating stem 22 with a throughbore 28. The operating stem 22 is received in the horizontal loop 15 of the knot support 10, shown in FIGS. 4 and 5, thus securing the camming element 24 to the knot support 10. The loop 15 is preferably large enough to provide the user with ready access to the operating stem 22. The throughbore 28 in the operating stem 22 receives the boss 18 that extends rearwardly from the knot support 10, shown in FIGS. 4 and 5. The boss 18 maintains the operating stem 22 within the loop 15. The camming element 24 is retained tightly against the knot support 10 with minimal play.

The camming element 24 receives and engages interengagable ends 32 of a neck band 34. Each end 32 includes mating zipper members 38.

Figure 12:
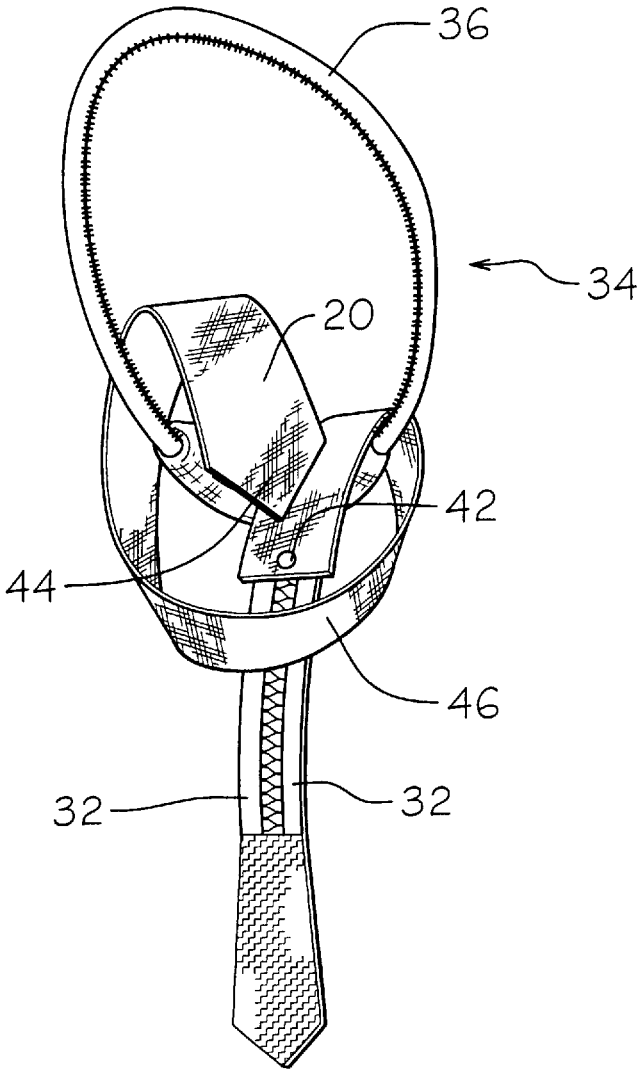
FIG. 12 is a frontal view of a front fabric member of the necktie of FIG. 11 being formed into a knot about the knot support and loop portion.

As shown in FIG. 12, the neck band 34 defines a loop 36 for encircling a wearer's neck (not shown). The loop 36 may be tightened about the wearer's neck by pulling down on the ends 32 relative to the camming element 24.

As also shown in FIGS. 11 and 12, the necktie includes a front member 20. The front member 20 corresponds to a wide end of a tie. The front member 20 may be mounted on the knot support 10 by inserting a rivet 42 through the front member 20 and the hole 16 of the knot support 10, and fastening the rivet 42. It should be appreciated that any other suitable fastener or attachment medium or device may replace the rivet 42.

FIG. 12 is a frontal view of a front fabric member of the necktie of FIG. 11 being formed into a knot about the knot support 10. As depicted, the front member 20 is fashioned about the knot support 10 and neck band 34 to resemble a tie knot. The distal end 44 of the front member 20 is pulled upwardly then back over the top of the knot support 10. The end 44 is pulled downwardly and around the front of the ends 32 of the neck band 34, thus defining a front loop 46. The end 44 of the front member 20 is drawn upwardly behind the knot support 10 then pulled forwardly over the top of the knot support 10. Finally, the end 44 is pulled downwardly through the loop 46 and tightened sufficiently to form a knot 48 (see FIG. 13).

Figure 13:
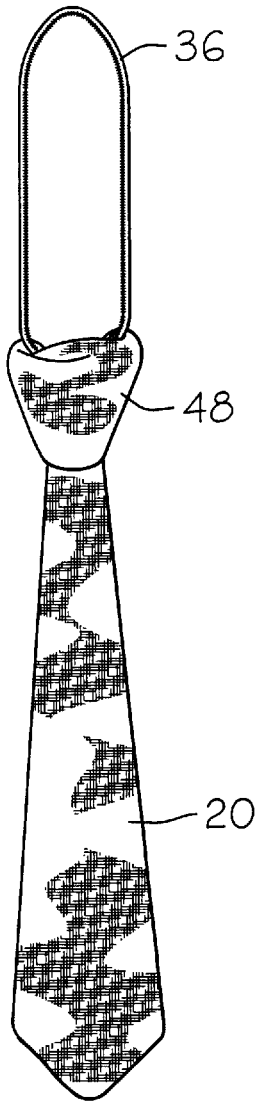
FIG. 13 is a frontal view of a completed necktie according to the invention.

FIG. 13 is a frontal view of a completed necktie according to the invention.

While the invention has been described in conjunction with the specific embodiments described above, many equivalent alternatives, modifications and variations may become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

For example, while a zippered tie has been described above, the knot support may also be used in, for example, a clip-on tie or the like. Those skilled in the art will appreciate that, when used in a clip-on tie, various ones of the above-described features would preferably be omitted. For example, in a clip-on tie, since there is no zipper, there would be no need for the loop 15.

Furthermore, although the above-described knot support is adapted for attachment with a separate camming element, the camming element may alternatively be formed as an integral part of the knot support.

Additionally, although the necktie described above includes a zipper, other alternatives are possible. For example, an arrangement is conceivable in which the ends 32 slide through the knot support 10 or an element attached to the knot support 10, but are only held together at the knot support 10 or element attached to the knot support 10, i.e., the ends are not fastened along their entire lengths.

What is claimed is:

1. A knot support and a zipper necktie combination, the knot support comprising:

a wedge shaped front having a wide upper portion and a narrow lower portion, a top edge of the wedge shaped front being located at the upper portion;

the top edge of the wedge shaped front forming a V-shape having two sides; and each side of the V-shape defining a substantially continuous curve as seen in frontal view.

2. The combination according to claim 1, further comprising a pair of prongs extending toward each other from opposite sides of the upper portion, each prong being spaced from the wedge shaped front.

3. The combination according to claim 2, wherein each prong is bent toward the wedge shaped front such that an imaginary line drawn as an extension of the prong intersects the wedge shaped front at a point of intersection such that, as seen in top view, a ratio of (1) a maximum interior width between the prongs to (2) a distance between the points of intersection is greater than or equal to 1.5:1.

4. The combination according to claim 2, wherein the prongs are spaced from each other at a predetermined spacing, and a ratio of (1) a maximum interior width between the prongs to (2) the predetermined spacing is less than or equal to 2:1.

5. The combination according to claim 2, wherein, as seen in rear view, a top edge of the prong is positioned below the top edge of the wedge shaped front.

6. The combination according to claim 1, wherein outside edges of the lower portion are substantially free of any rearwardly extending wall.

7. The combination according to claim 1, wherein a front surface of at least the upper portion is convex.

8. The combination according to claim 1, wherein outside upper corners of the wedge shaped front are rounded as seen in frontal view.

9. The combination according to claim 1, wherein a front surface of at least the upper portion is convex.

10. The combination according to claim 1, wherein outside upper corners of the wed aped front are rounded as seen in frontal view.

11. The combination according to claim 1, wherein the sides of the V-shape converge to a common point.

12. A necktie, comprising:

a knot support comprising a wedge shaped front having a wide upper portion and a narrow lower portion, a top edge of the wedge shaped front being located at the upper portion, the top edge of the wedge shaped front forming a V-shape having two sides, and each side of the V-shape defining a substantially continuous curve as seen in frontal view a front fabric portion attached to the knot support; and a loop portion forming a loop and having ends engageable by the knot support, the knot support being slidable relative to the loop portion to adjust a size of the loop.

13. The necktie according to claim 12, further comprising:

mutually engageable zipper portions attached respectively to the ends of the loop member; and a camming element that engages the zipper portions and causes the zipper portions to mutually engage when the zipper portions are passed through the camming element in a first direction, and causes the zipper portions to mutually disengage when the zipper portions are passed through the camming element in a second direction.

14. The necktie according to claim 12, wherein the sides of the V-shape converge to a common point.

15. A knot support and a zipper necktie combination, comprising:

a wedge shaped front having a wide upper portion and a narrow lower portion, a top edge of the wedge shaped front being located at the upper portion;

the top edge of the wedge shaped front forming a V-shape; and outside edges of the lower portion being substantially free of any rearwardly extending wall.

16. The combination according to claim 15, further comprising a pair of prongs extending toward each other from opposite sides of the upper portion, each prong being spaced from the wedge shaped front.

17. The combination according to claim 16, wherein each prong is bent toward the wedge shaped front such that an imaginary line drawn as an extension of the prong intersects the wedge shaped front at a point of intersection such that, as seen in top view, a ratio of (1) a maximum interior width between the prongs to (2) a distance between the points of intersection is greater than or equal to 1.5:1.

18. The combination according to claim 16, wherein the prongs are spaced from each other at a predetermined spacing, and a ratio of (1) a maximum interior width between the prongs to (2) the predetermined spacing is less than or equal to 2:1.

19. The combination according to claim 16, wherein, as seen in rear view, a top edge of the prong is positioned below the top edge of the wedge shaped front.

20. The combination according to claim 15, wherein the V-shape has two sides that converge to a common point.

21. A necktie, comprising:

a knot support comprising a wedge shaped front having a wide upper portion and a narrow lower portion, a top edge of the wedge shaped front being located at the upper portion, the top edge of the wedge shaped front forming a V-shape, and outside edges of the lower portion being substantially free of any rearwardly extending wall;

a front fabric portion attached to the knot support; and a loop portion forming a loop and having ends engageable by the knot support, the knot support being slidable relative to the loop portion to adjust a size of the loop.

22. The necktie according to claim 21, further comprising:

mutually engageable zipper portions attached respectively to the ends of the loop member; and a camming element that engages the zipper portions and causes the zipper portions to mutually engage when the zipper portions are passed through the camming element in a first direction, and causes the zipper portions to mutually disengage when the zipper portions are passed through the camming element in a second direction.

23. The necktie according to claim 21, wherein the V-shape has two sides that converge to a common point.

24. A knot support for a necktie, comprising:

a wedge shaped front having a wide upper portion and a narrow lower portion, a top edge of the wedge shaped front being located at the upper portion;

the top edge of the wedge shaped front forming a V-shape; and a pair of prongs extending toward each other from opposite sides of the upper portion, each prong being spaced from the wedge shaped front, wherein each prong is bent toward the wedge shaped front such that an imaginary line drawn as an extension of the prong intersects the wedge shaped front at a point of intersection such that, as seen in top view, a ratio of (1) a maximum interior width between the prongs to (2) a distance between the points of intersection is greater than or equal to 1.5:1.

25. The knot support according to claim 24, wherein the prongs are spaced from each other at a predetermined spacing, and a ratio of (1) a maximum interior width between the prongs to (2) the predetermined spacing is less than or equal to 2:1.

26. The knot support according to claim 24, wherein, as seen in rear view, a top edge of the prong is positioned below the top edge of the wedge shaped front.

27. The knot support according to claim 24, wherein the lower portion is substantially free of any rearwardly extending wall.

28. The knot support according to claim 24, wherein a front surface of at least the upper portion is convex.

29. The knot support according to claim 24, wherein outside upper corners of the wedge shaped front are rounded as seen in frontal view.

30. A necktie, comprising:

the knot support according to claim 24, a front fabric portion attached to the knot support; and attachment means for attaching the knot support and front fabric portion to a wearer's neck.

31. A necktie, comprising:

the knot support according to claim 24, a front fabric portion attached to the knot support; and a loop portion forming a loop and having ends engageable by the knot support, the knot support being slidable relative to the loop portion to adjust a size of the loop.

32. The necktie according to claim 31, further comprising:

mutually engageable zipper portions attached respectively to the ends of the loop member; and a camming element that engages the zipper portions and causes the zipper portions to mutually engage when the zipper portions are passed through the camming element in a first direction, and causes the zipper portions to mutually disengage when the zipper portions are passed through the camming element in a second direction.

33. The knot support according to claim 24, wherein the V-shape has two sides that converge to a common point.

34. A knot support for a necktie, comprising:

a wedge shaped front having a wide upper portion and a narrow lower portion, a top edge of the wedge shaped front being located at the upper portion;

the top edge of the wedge shaped front forming a V-shape having two sides;

each side of the V-shape defining a substantially continuous curve as seen in frontal view; and a pair of prongs extending toward each other from opposite sides of the upper portion, each prong being spaced from the wedge shaped front;

wherein, as seen in rear view, a top edge of the prong is positioned below the top edge of the wedge shaped front.

35. The knot support according to claim 34, wherein the sides of the V-shape converge to a common point.

36. A knot support for a necktie, comprising:

a wedge shaped front having a wide upper portion and a narrow lower portion, a top edge of the wedge shaped front being located at the upper portion;

the top edge of the wedge shaped front forming a V-shape;

outside edges of the lower portion being substantially free of any rearwardly extending wall; and a pair of prongs extending toward each other from opposite sides of the upper portion, each prong being spaced from the wedge shaped front;

wherein, as seen in rear view, a top edge of the prong is positioned below the top edge of the wedge shaped front.

37. The knot support according to claim 36, wherein the V-shape has two sides that converge to a common point.

* * * * *